US008337215B2

(12) United States Patent
Yu

(10) Patent No.: US 8,337,215 B2
(45) Date of Patent: Dec. 25, 2012

(54) CARD-EDGE CONNECTOR

(75) Inventor: Chen Chin Yu, Taipei (TW)

(73) Assignee: Tyco Electronics Holdings (Bermuda) No. 7 Limited, Pembroke (BM)

( * ) Notice: Subject to any disclaimer, the term of this patent is extended or adjusted under 35 U.S.C. 154(b) by 0 days.

(21) Appl. No.: 13/190,734

(22) Filed: Jul. 26, 2011

(65) Prior Publication Data

US 2012/0028482 A1 Feb. 2, 2012

(30) Foreign Application Priority Data

Jul. 30, 2010 (TW) ..... 99214607 U

(51) Int. Cl.
*H01R 12/00* (2006.01)

(52) U.S. Cl. ..... 439/59

(58) Field of Classification Search ..... 439/59, 439/79

See application file for complete search history.

(56) References Cited

U.S. PATENT DOCUMENTS 4,555,847 A * 12/1985 Dornes et al. ..... 29/739
5,192,220 A * 3/1993 Billman et al. ..... 439/327
5,308,257 A * 5/1994 Buchter et al. ..... 439/267
5,334,046 A * 8/1994 Brouillette et al. ..... 439/541.5
5,492,481 A * 2/1996 Lewis ..... 439/159
5,573,408 A * 11/1996 Laub et al. ..... 439/62
5,679,018 A * 10/1997 Lopata et al. ..... 439/260
5,913,699 A * 6/1999 Zielke ..... 439/632
5,980,272 A * 11/1999 McHugh et al. ..... 439/79
5,980,292 A * 11/1999 Rothenberger et al. ..... 439/260
6,012,928 A * 1/2000 Lopata et al. ..... 439/67
6,089,904 A * 7/2000 Wu ..... 439/495
6,116,917 A * 9/2000 Choy ..... 439/79
6,152,742 A * 11/2000 Cohen et al. ..... 439/60
6,352,451 B1 * 3/2002 Henneberger et al. ..... 439/668
6,419,503 B1 * 7/2002 Choy ..... 439/79
6,454,157 B2 * 9/2002 Olson ..... 228/180.21
6,464,537 B1 * 10/2002 Letourneau et al. ..... 439/607.14
6,551,116 B1 * 4/2003 Liu ..... 439/79

(Continued)

FOREIGN PATENT DOCUMENTS

JP 5-20269 3/1993

(Continued)

*Primary Examiner* — Amy Cohen Johnson
*Assistant Examiner* — Vladimir Imas
(74) *Attorney, Agent, or Firm* — Barley Snyder

(57) ABSTRACT

The invention relates to a card-edge connector for securing and electrically connecting an electronic card to a circuit board. The card-edge connector includes an insulative, a set of first conductive terminals, a spacer, and a pair of card latching members. The insulative housing includes a plurality of first terminal receiving passageways positioned on an upper surface thereof and a plurality of second terminal receiving passageways positioned on the lower surface of the insulative housing. The set of first conductive terminals are alternately positioned in the plurality of first terminal receiving passageways and include a plurality of exposed end portions. The set of second conductive terminals are positioned in the plurality of second terminal receiving passageways and include a plurality of exposed end portions of the set of second conductive terminals. The spacer includes a plurality of receiving passageways and a plurality of third terminal receiving passageways positioned at a rear edge securing the plurality of exposed end portions of the set of first conductive terminals and the plurality of exposed end portions of the set of second conductive terminals. The pair of card latching members are inserted respectively into two catches respectfully positioned at two ends of a front side of the insulative housing.

33 Claims, 15 Drawing Sheets

U.S. PATENT DOCUMENTS

| | | | | |
|---|---|---|---|---|
| 6,731,517 | B1 * | 5/2004 | Yu | 361/807 |
| 6,811,414 | B1 * | 11/2004 | Consoli et al. | 439/79 |
| 6,814,583 | B1 * | 11/2004 | Young et al. | 439/65 |
| 6,979,206 | B2 * | 12/2005 | Bu et al. | 439/79 |
| 7,390,194 | B1 * | 6/2008 | Crippen et al. | 439/65 |
| 7,540,742 | B2 | 6/2009 | Hardell | |
| 7,717,721 | B2 * | 5/2010 | Wu et al. | 439/79 |
| 7,727,000 | B2 * | 6/2010 | Minich | 439/377 |
| 7,794,267 | B2 * | 9/2010 | Daily | 439/409 |
| 7,828,560 | B2 * | 11/2010 | Wu et al. | 439/79 |
| 7,878,846 | B2 | 2/2011 | Zhu | |
| 8,052,449 | B2 * | 11/2011 | Zhu | 439/326 |
| 8,177,564 | B1 * | 5/2012 | Ito et al. | 439/108 |
| 2001/0015373 | A1 * | 8/2001 | Olson | 228/180.22 |
| 2002/0072263 | A1 * | 6/2002 | Fumikura | 439/327 |
| 2003/0003804 | A1 * | 1/2003 | Letourneau et al. | 439/608 |
| 2005/0059278 | A1 * | 3/2005 | Zhang | 439/83 |
| 2005/0153585 | A1 * | 7/2005 | Bu et al. | 439/79 |
| 2010/0035473 | A1 * | 2/2010 | Wu et al. | 439/629 |
| 2011/0059654 | A1 * | 3/2011 | Zhu | 439/630 |
| 2011/0097936 | A1 * | 4/2011 | Hirata | 439/626 |
| 2011/0262077 | A1 * | 10/2011 | Anderson et al. | 385/78 |
| 2011/0263146 | A1 | 10/2011 | Su | |
| 2012/0028482 | A1 * | 2/2012 | Yu | 439/59 |

FOREIGN PATENT DOCUMENTS

| | | |
|---|---|---|
| TW | 405772 | 9/2000 |
| TW | 331820 | 5/2008 |
| TW | 201104978 | 2/2011 |

* cited by examiner

CARD-EDGE CONNECTOR

CROSS-REFERENCE TO RELATED APPLICATIONS

This application claims the benefit of the filing date under 35 U.S.C. §119(a)-(d) of Taiwanese Utility Model Application No. 99214607, filed Jul. 30, 2010.

FIELD OF THE INVENTION

The present invention relates to a card-edge connector, and more particularly, to a card-edge connector having conductive terminals.

BACKGROUND

In general, a circuit board for typical electronic devices includes different card-edge connectors that provide slot connection for various modular electronic cards. Electrical contacts on a front edge of these cards make electrical contact with corresponding conductive terminals on the card-edge connectors to complete electrical conduction between the electronic cards and the main circuit board.

For known card-edge connectors, the connection between conductive terminals and the insulative housing is generally made by inserting conductive terminals of various sizes into a plurality of receiving passageways arranged alternately in a top-down sequence on a side surface of the insulative housing. The main circuit board is provided with a corresponding number of receiving passageways for the conductive terminals so that the conductive terminals can be inserted and soldered in the receiving passageways. Consequently, electrical conduction between the electronic cards and the main circuit board can be achieved. As the conductive terminals of various sizes are inserted to the receiving passageways, arranged alternately in a top-down sequence on the side surface of the insulative housing, the addition of conductive terminals that connect the electronic card with the main circuit board requires increased thickness of the insulative housing and the number of rows of receiving passageways arranged in an alternating pattern and the receiving passageways on the main circuit board. The section between any two receiving passageways is rather small, thus the layout of the circuit is designed to permit only one wire to pass through the section. Accordingly, the number of layers of a circuit needs to be increased when the number of receiving passageways increases. For example, a four-layer layout is required for four rows of receiving passageways. Such a configuration not only incurs higher costs but also increases the thickness of the insulative housing, taking up much of the overall space. Therefore, a need exists in the art to deal with the higher costs incurred by the increased number of receiving passageways on the main circuit board and the increased thickness caused by the combination of the conductive terminals within the insulative housing, thereby the space of an electronic device can be managed efficiently and the costs can be reduced as well.

SUMMARY

An object of the invention is to provide a card-edge connector that connects with the upper and lower surfaces of the housing through conductive terminals of three different sizes so as to effectively reduce the space required for the conductive terminals and the number of conductive terminals. With such an arrangement, the costs can be further reduced.

The card-edge connector includes an insulative, a set of first conductive terminals, a spacer, and a pair of card latching members. The insulative housing includes a plurality of first terminal receiving passageways positioned on an upper surface thereof and a plurality of second terminal receiving passageways positioned on the lower surface of the insulative housing. The set of first conductive terminals are alternately positioned in the plurality of first terminal receiving passageways and include a plurality of exposed end portions. The set of second conductive terminals are positioned in the plurality of second terminal receiving passageways and include a plurality of exposed end portions of the set of second conductive terminals. The spacer includes a plurality of receiving passageways and a plurality of third terminal receiving passageways positioned at a rear edge securing the plurality of exposed end portions of the set of first conductive terminals and the plurality of exposed end portions of the set of second conductive terminals. The pair of card latching members are inserted respectively into two catches respectfully positioned at two ends of a front side of the insulative housing.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENT(S)

Figure 1:
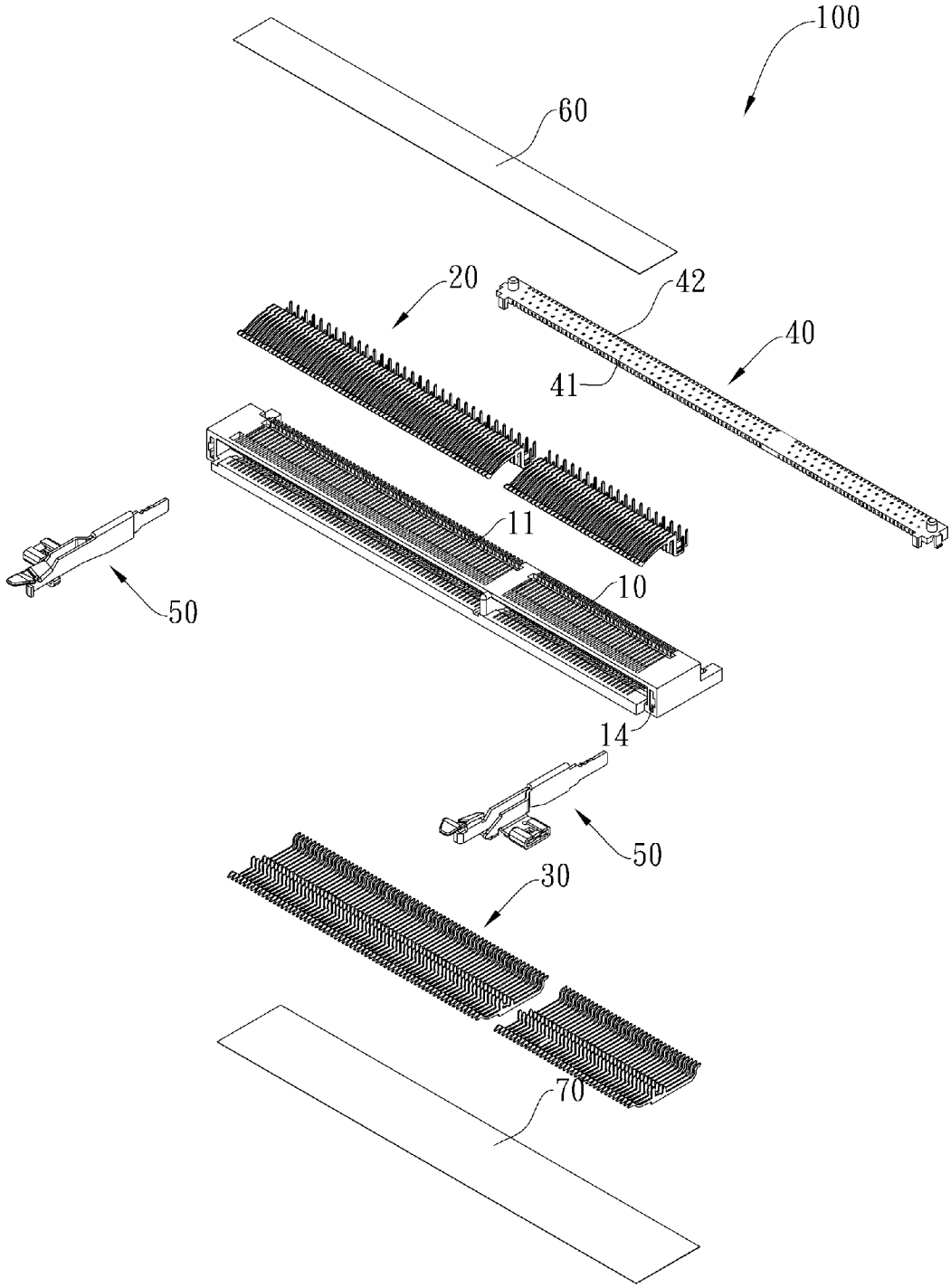
FIG. 1 is an exploded perspective view of a card-edge connector according to the invention.
Figure 3A:
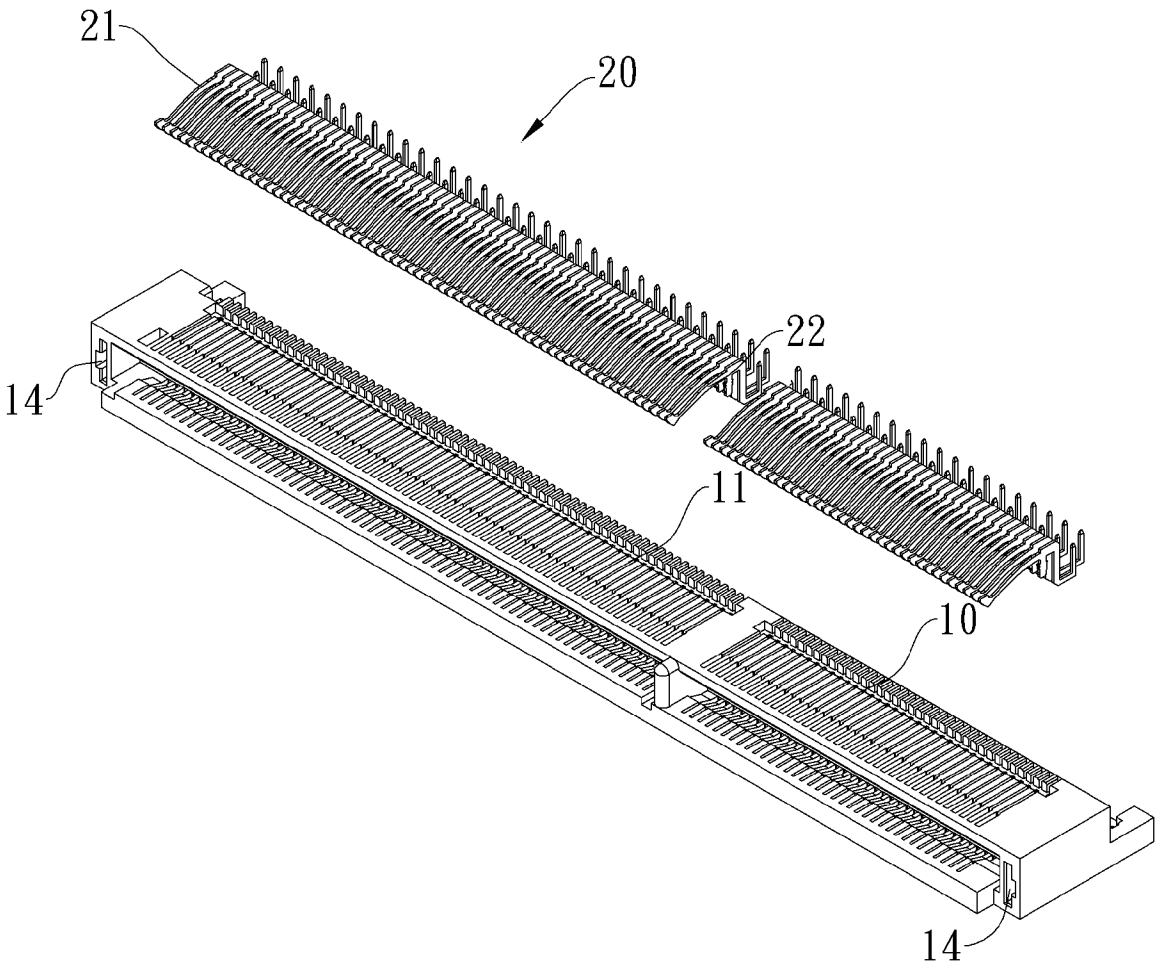
FIG. 3A is an exploded perspective view of a set of first conductive terminals and an insulative housing of the card-edge connector according to the invention.
Figure 3B:
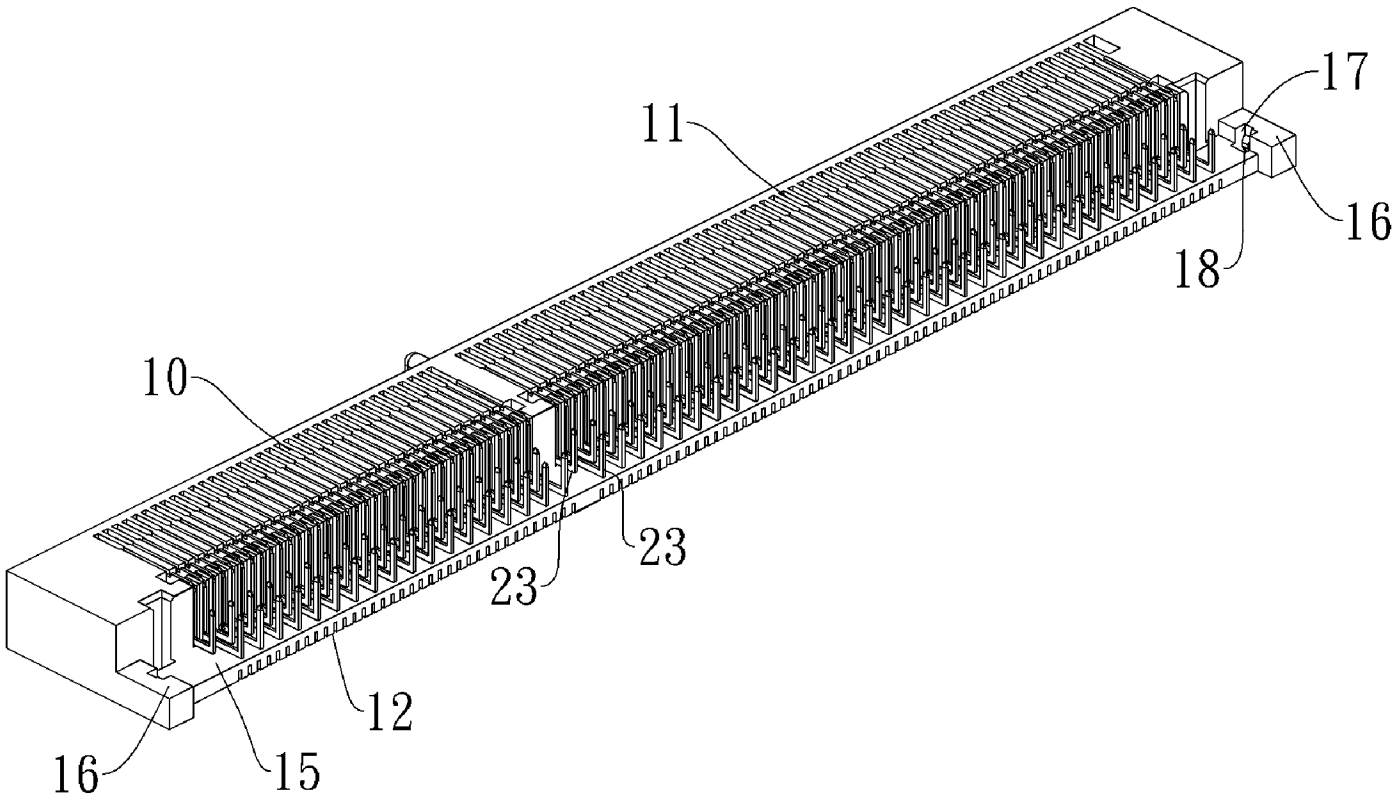
FIG. 3B is a perspective view of the set of first conductive terminals with an insulative housing of the card-edge connector according to the invention.
Figure 4A:
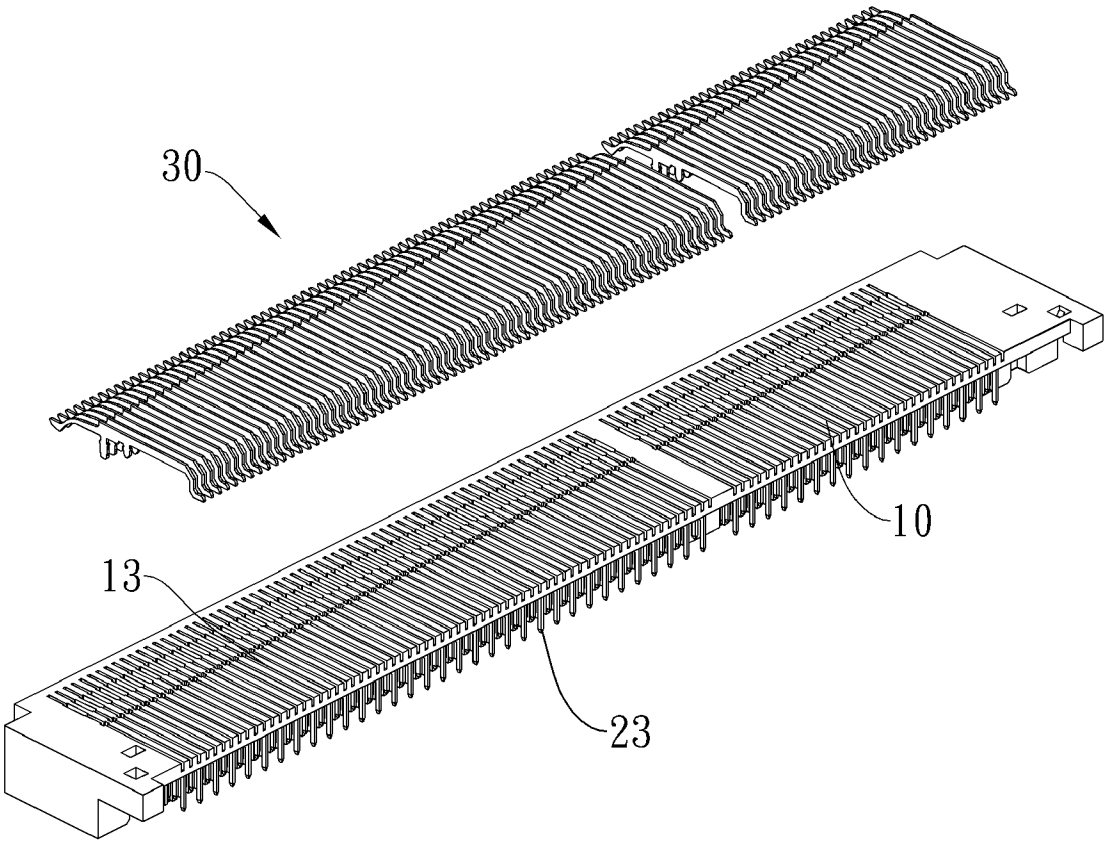
FIG. 4A is an exploded perspective view of a set of second conductive terminals and the insulative housing of the card-edge connector according to the invention.
Figure 4B:
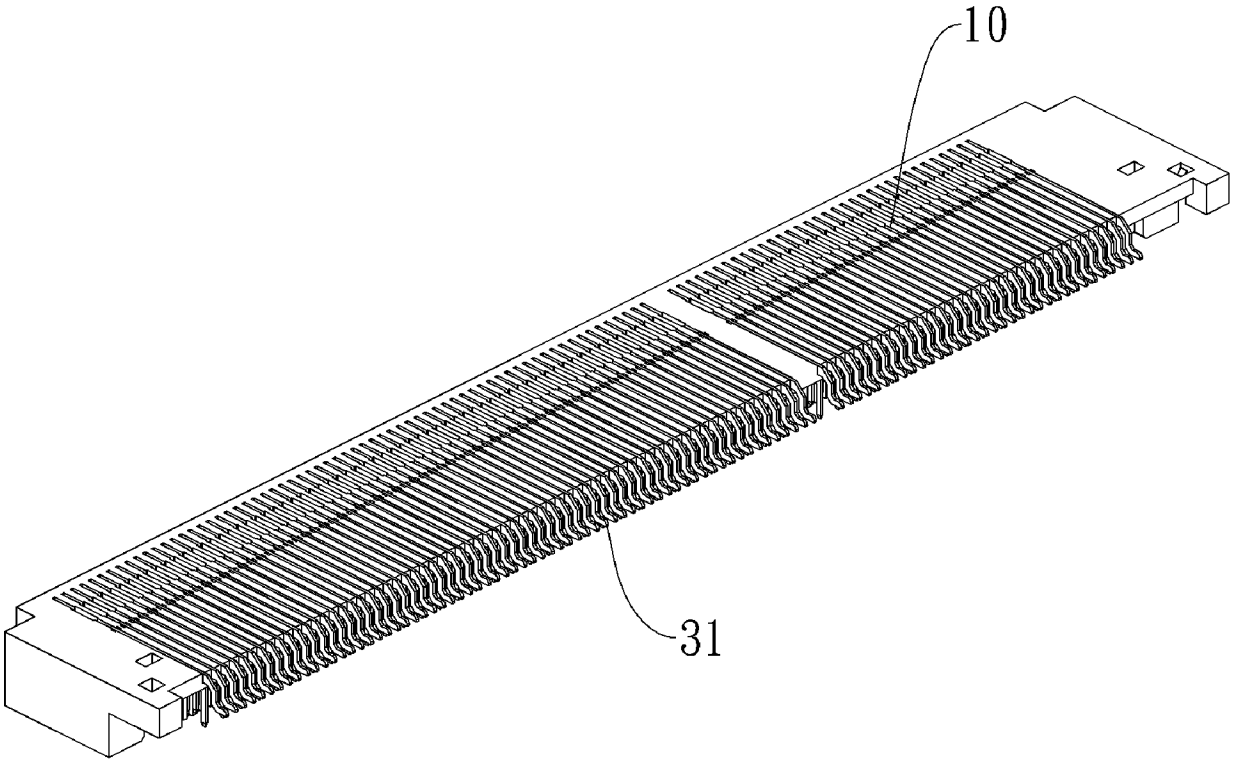
FIG. 4B is a perspective view of the set of second conductive terminals and the insulative housing of the card-edge connector according to the invention.
Figure 5A:
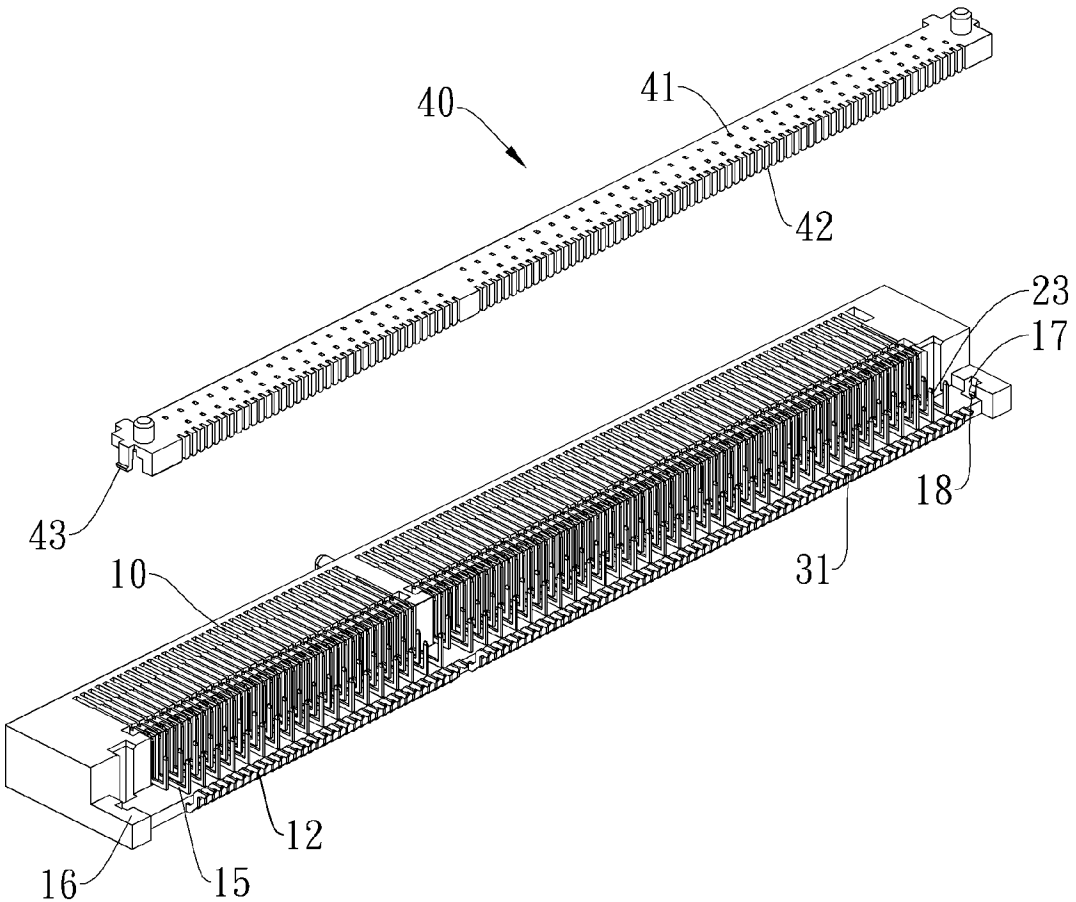
FIG. 5A is an exploded perspective view of a spacer and an insulative housing connected with a set of first conductive terminals and a set of second conductive terminals in the card-edge connector according to the invention.
Figure 5B:
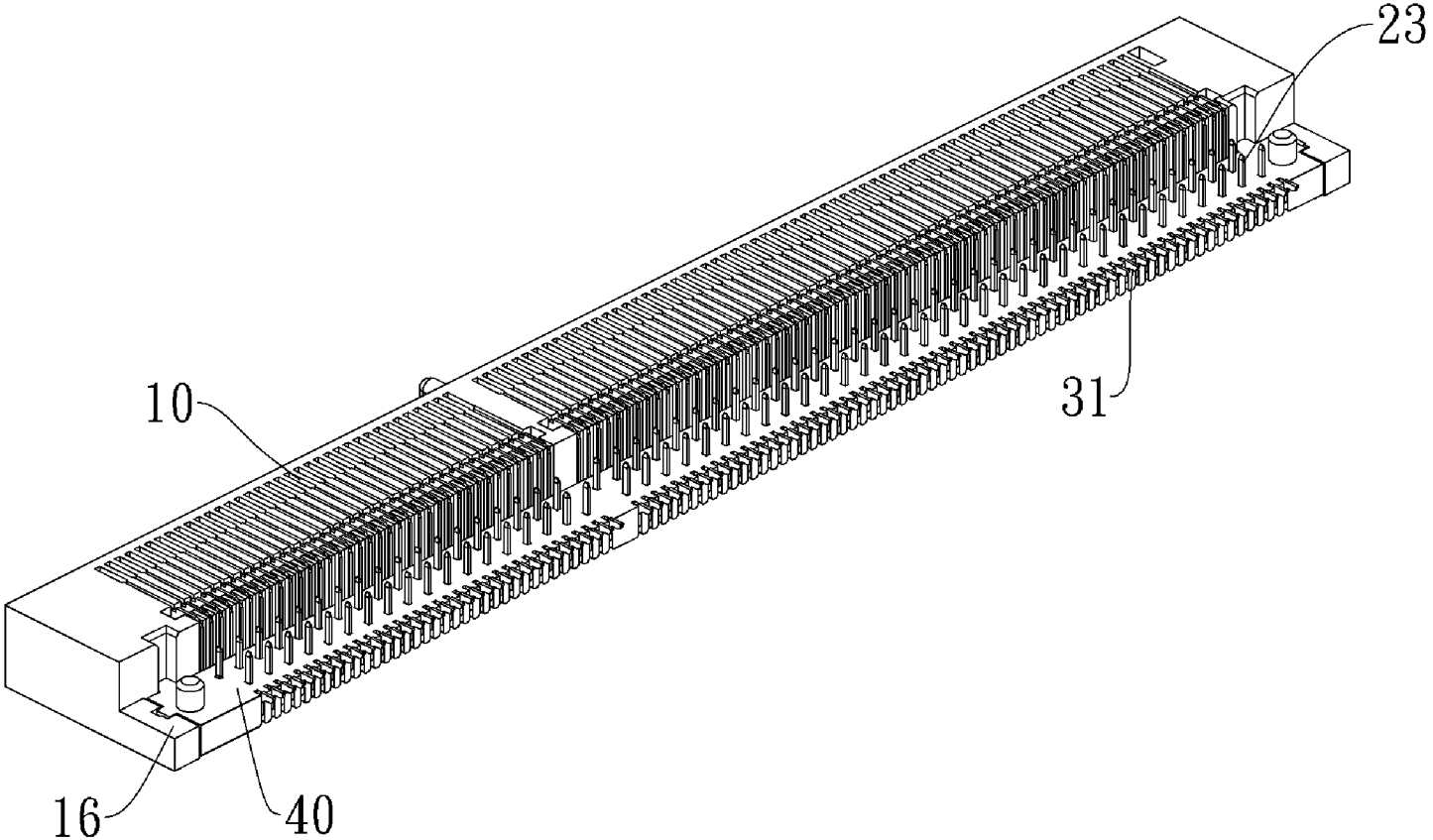
FIG. 5B is a perspective view of the spacer connected to the set of first conductive terminals and the set of second conductive terminals on the insulative housing of the card-edge connector according to the invention.
Figure 6A:
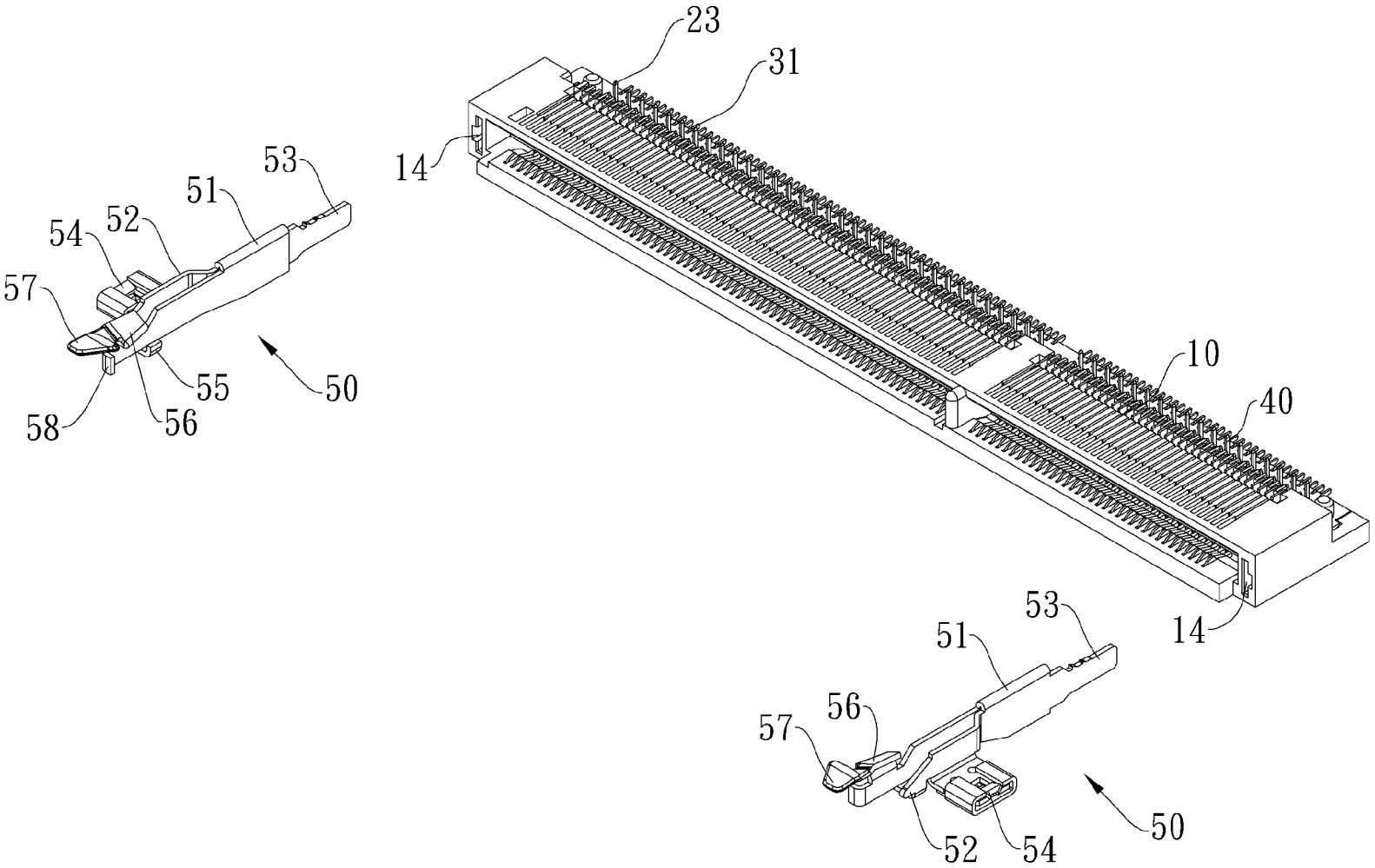
FIG. 6A is an exploded perspective view of a pair of card latching members and the insulative housing of the card-edge connector according to the present invention.
Figure 6B:
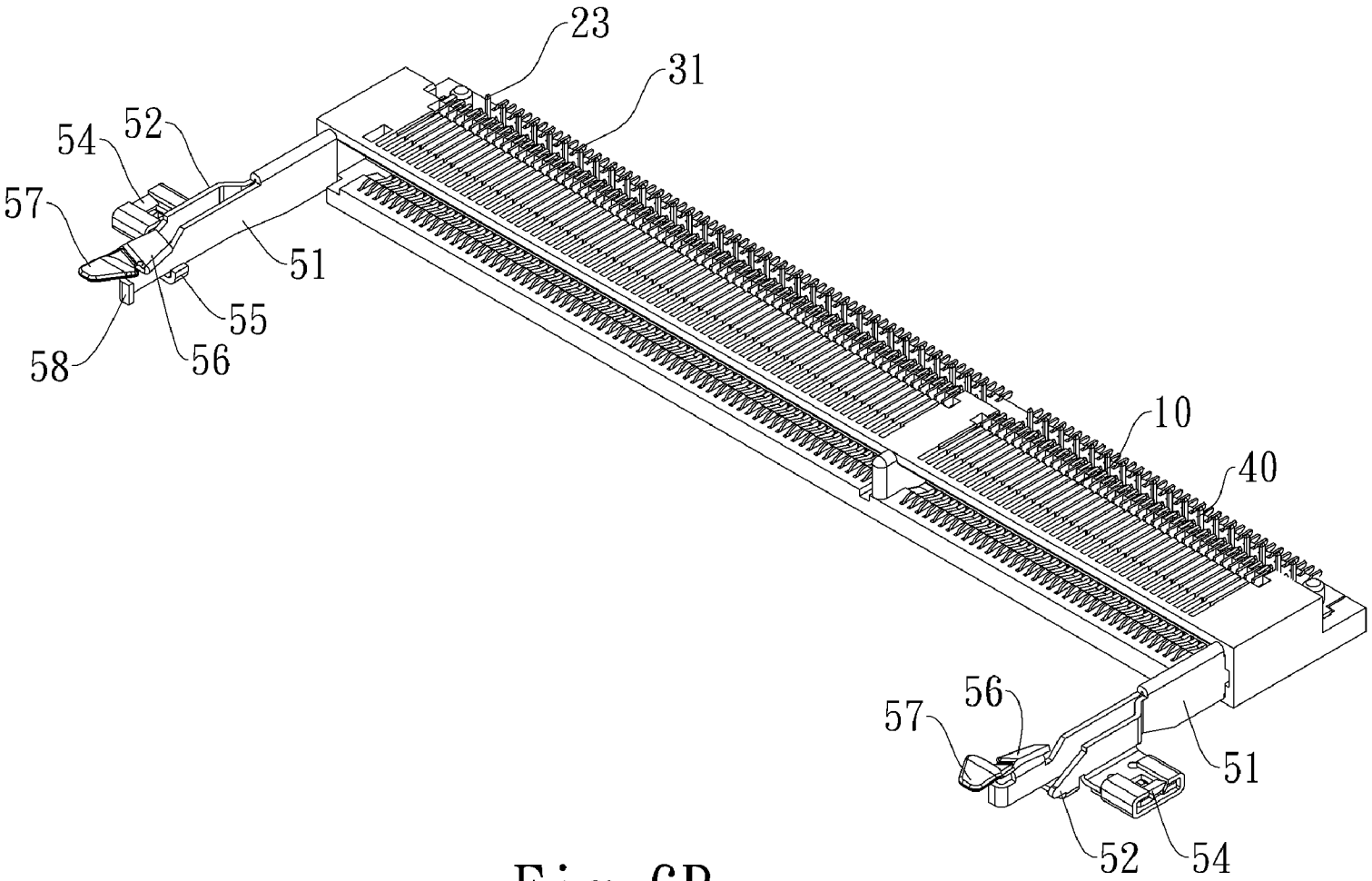
FIG. 6B is a perspective view showing the pair of card latching members connecting with the insulative housing of the card-edge connector according to the invention.

Referring to FIG. 1, the invention provides a card-edge connector 100 for securing and electrically connecting an electronic card 1 (see FIGS. 8A-8C) to a circuit board (not shown). The card-edge connector 100 includes an insulative housing 10, a set of first conductive terminals 20, a set of second conductive terminals 30, a spacer 40, and a pair of card latching members 50. The insulative housing 10 includes a plurality of first terminal receiving passageways 11 arranged on an upper surface thereof and one end of each of the plurality of first terminal receiving passageways 11 ended at a rear edge of the upper surface thereof, a base 12 (see FIGS. 2A and 2B) extending rearward from a rear edge of a lower surface of the insulative housing 10, a plurality of second terminal receiving passageways 13 (see FIG. 4A) being arranged on the lower surface of the insulative housing 10 and a lower surface of the base 12, two catches 14 being arranged respectively on the two ends of a front side of the insulative housing 10. The set of first conductive terminals 20 are positioned alternately in the plurality of first terminal receiving passageways 11 arranged on the upper surface of the insulative housing 10 with one ends thereof ended at the rear edge of the upper surface. The set of first conductive terminals 20 includes a plurality of exposed end portions 23 (see FIG. 3B) positioned on the base 12 and extending in a direction perpendicular to a direction in which the electronic card 1 is inserted; a set of second conductive terminals 30 positioned in the plurality of second terminal receiving passageways 13 (see FIGS. 4A and 4B). The set of second conductive terminals 30 include a plurality of exposed end portions 31 (see FIG. 4B) positioned along the base 12 and extending in the direction perpendicular to the direction in which the electronic card 1 is inserted. The spacer 40 is configured to secure the plurality of exposed end portions 23 of the set of first conductive terminals 20 and the plurality of exposed end portions 31 of the set of second conductive terminals 30 (see FIGS. 5A and 5B). The spacer 40 includes a plurality of receiving passageways 41 corresponding to the set of first conductive terminals 20, a rear edge thereof having a plurality of third terminal receiving passageways 42 corresponding to the set of second conductive terminals 30. The pair of card latching members 50 are inserted respectively into the two catches 14 arranged at the two ends of the front side of the insulative housing 10, so as to secure and/or hold the electronic card 1 (see FIGS. 8A-8C).

Figure 2B:
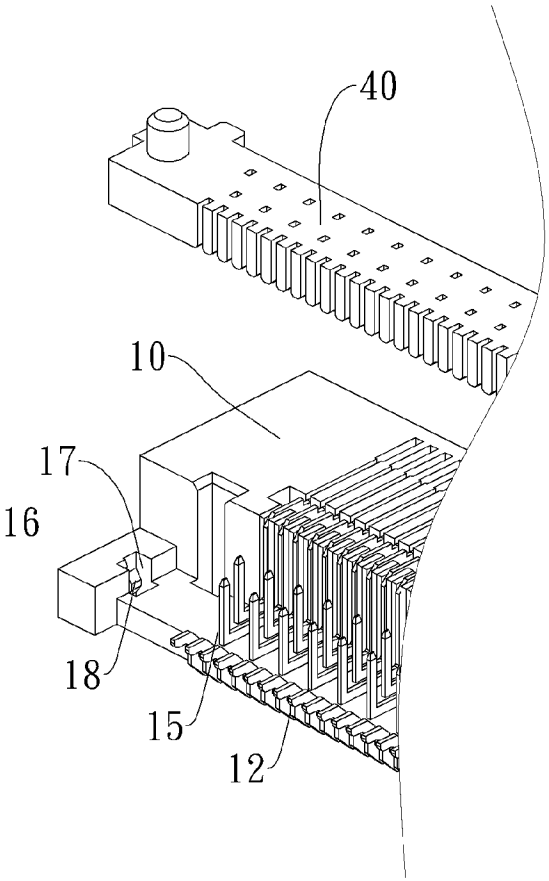
FIG. 2B is a partial exploded enlarged perspective view of the insulative housing and the spacer of FIG. 2A shown from a reverse angle.
Figure 2A:
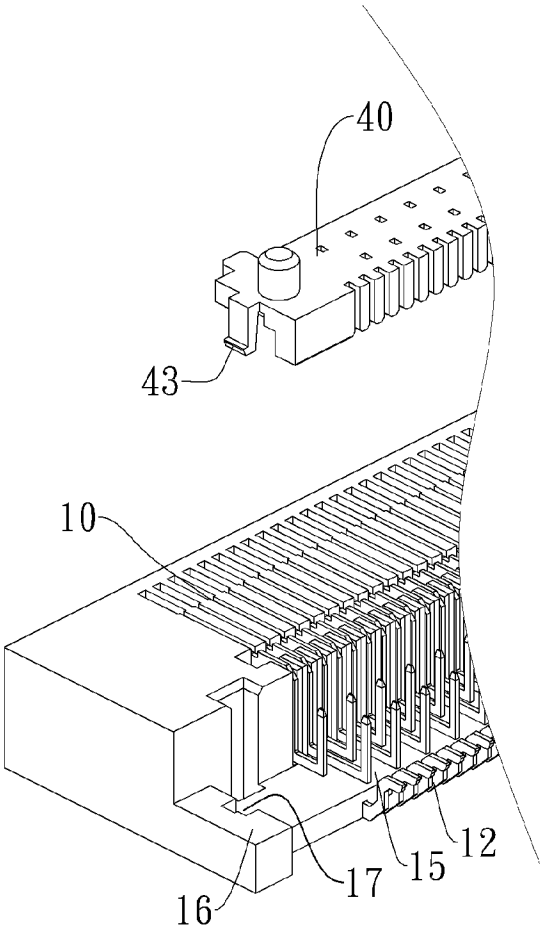
FIG. 2A is a partial exploded enlarged perspective view of an insulative housing and a spacer of the card-edge connector according to the invention.

With reference to FIG. 1 and FIGS. 2A and 2B, the base 12 is shown having a horizontal section 15 and two vertical sections 16 extending respectively from the two ends of the horizontal section 15. A receiving passageway 17 is defined in a region where the horizontal section 15 and the vertical section 16 join, and the wall of the through receiving passageway 17 is provided with a clasp portion 18. Each of the two ends of the spacer 40 is provided with a hook portion 43 corresponding to the clasp portion 18 so that the hook portion 43 will engage with the clasp portion 18 to connect the spacer 40 and the insulative housing 10 when the spacer 40 secures the plurality of exposed end portions 23 of the set of first conductive terminals 20 and the plurality of exposed end portions 31 of the set of second conductive terminals 30.

Referring to FIG. 1, each of the pair of card latching members 50 has a main body 51 from one side of which an extension 52 branches out, and the front end of the main body 51 is provided with a pair of insertion sections 53 corresponding to the two catches 14 arranged at the two ends of the front side of the insulative housing 10. The pair of insertion sections 53 are configured to connect with the two catches 14 of the insulative housing 10. The extension 52 of each of the pair of card latching members 50 includes a fixing portion 54 at one side thereof for locking the card-edge connector 100 to a circuit board (not shown), and the other side thereof includes a resting portion 55 for supporting the electronic card 1 (see FIGS. 8A-8C). The main body 51 includes a clutch portion 56 extending from the upper edge of the rear end thereof to clutch the electronic card 1 (see FIGS. 8A-8C), and a pressing portion 57 that extends rearward from the clutch portion 56. The rear end of the main body 51 includes a clasp portion 58 that engages with a corresponding recess 3 of the electronic card 1 (see FIGS. 8A-8C).

Referring to FIGS. 1-2B and FIGS. 3A-6B, the assembly of a card-edge connector 100 according to the invention is illustrated. The first terminal 21 (the longer terminal) and the second terminal 22 (the shorter terminal) of the set of first conductive terminals 20 are alternately and vertically positioned in the plurality of first terminal receiving passageways 11 (see FIGS. 3A and 3B) that is positioned along the upper surface of the insulative housing 10. After the first terminal 21 and the second terminal 22 have been positioned in the plurality of first terminal receiving passageways 11, the plurality of exposed end portions 23 thereof are on the upper surface of the base 12. Next, the set of second conductive terminals 30 are vertically positioned in the plurality of second terminal receiving passageways 13 (see FIGS. 4A and 4B) that is arranged on the lower surface of the insulative housing 10 and the lower surface of the base 12. Next, the plurality of receiving passageways 41 of the spacer 40 are passed through by the plurality of exposed end portions 23 of the set of first conductive terminals 20, which are separated from the insulative housing 10, and the plurality of third terminal receiving passageways 42 of the spacer 40 receive the plurality of exposed end portions 31 of the set of second conductive terminals 30, thereby the plurality of exposed end portions 23 of the set of first conductive terminals 20 and the plurality of exposed end portions 31 of the set of second conductive terminals 30 are secured. Next, the hook portion 43 of the spacer 40 passes through the through receiving passageway 17 in order to engage the clasp portion 18 of the base 12, so as to connect the spacer 40 and the insulative housing 10 (see FIGS. 5A and 5B). Next, the insertion sections 53 of the pair of card latching members 50 are inserted within the two catches 14 (see FIGS. 6A and 6B) that are positioned at two ends of the front side of the insulative housing 10 in order to complete the assembly of the card-edge connector 100 according to the invention.

Figure 7:
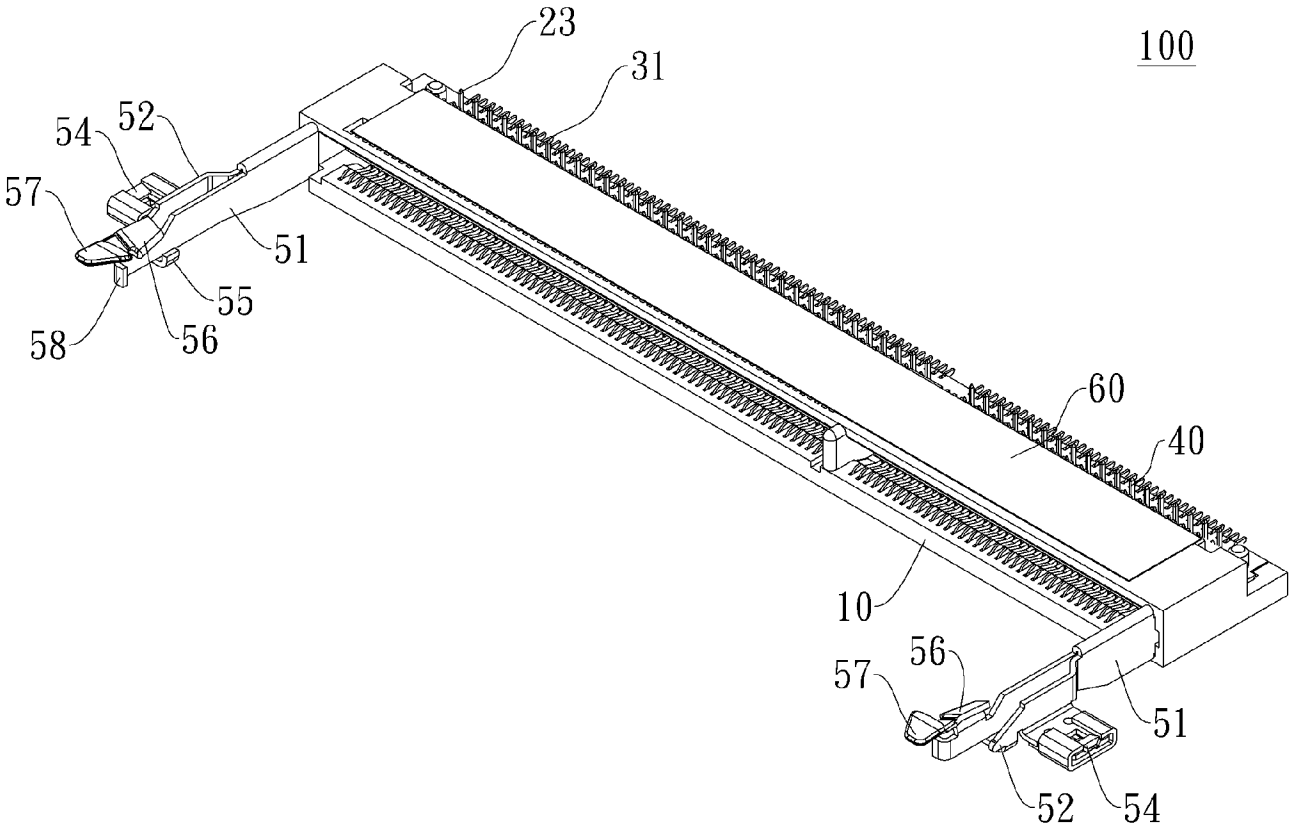
FIG. 7 is a perspective view showing the card-edge connector according to the invention.

Referring to FIG. 1 and FIG. 7, the card-edge connector 100 further includes an upper cover 60 configured to cover and secure the set of first conductive terminals 20 arranged on the upper surface of the insulative housing 10 and a lower cover 70 configured to cover and secure the set of second conductive terminals 30 arranged on the lower surface of the insulative housing 10.

Figure 8A:
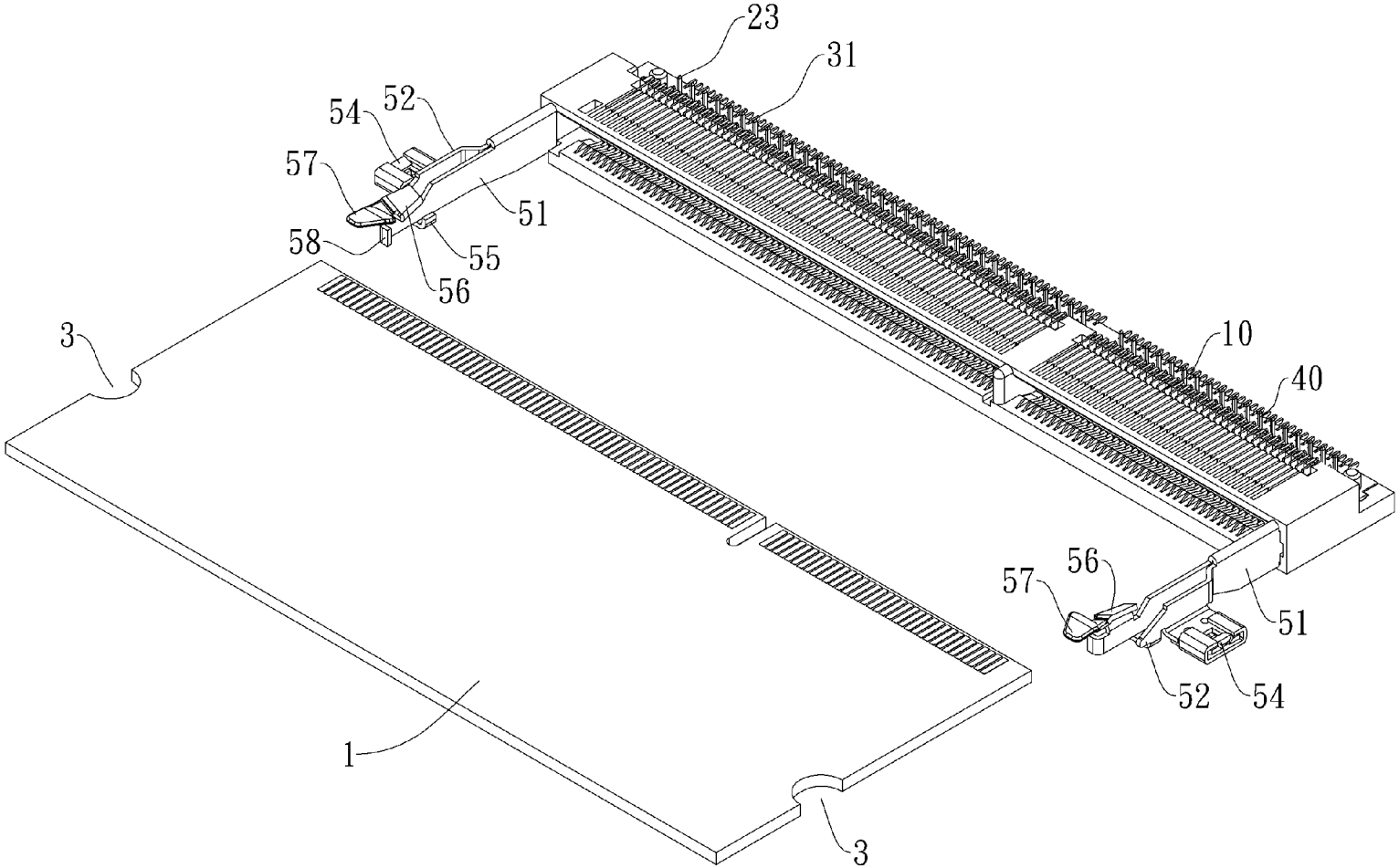
FIG. 8A is an exploded perspective view of the card-edge connector according to the invention and an electronic card.
Figure 8B:
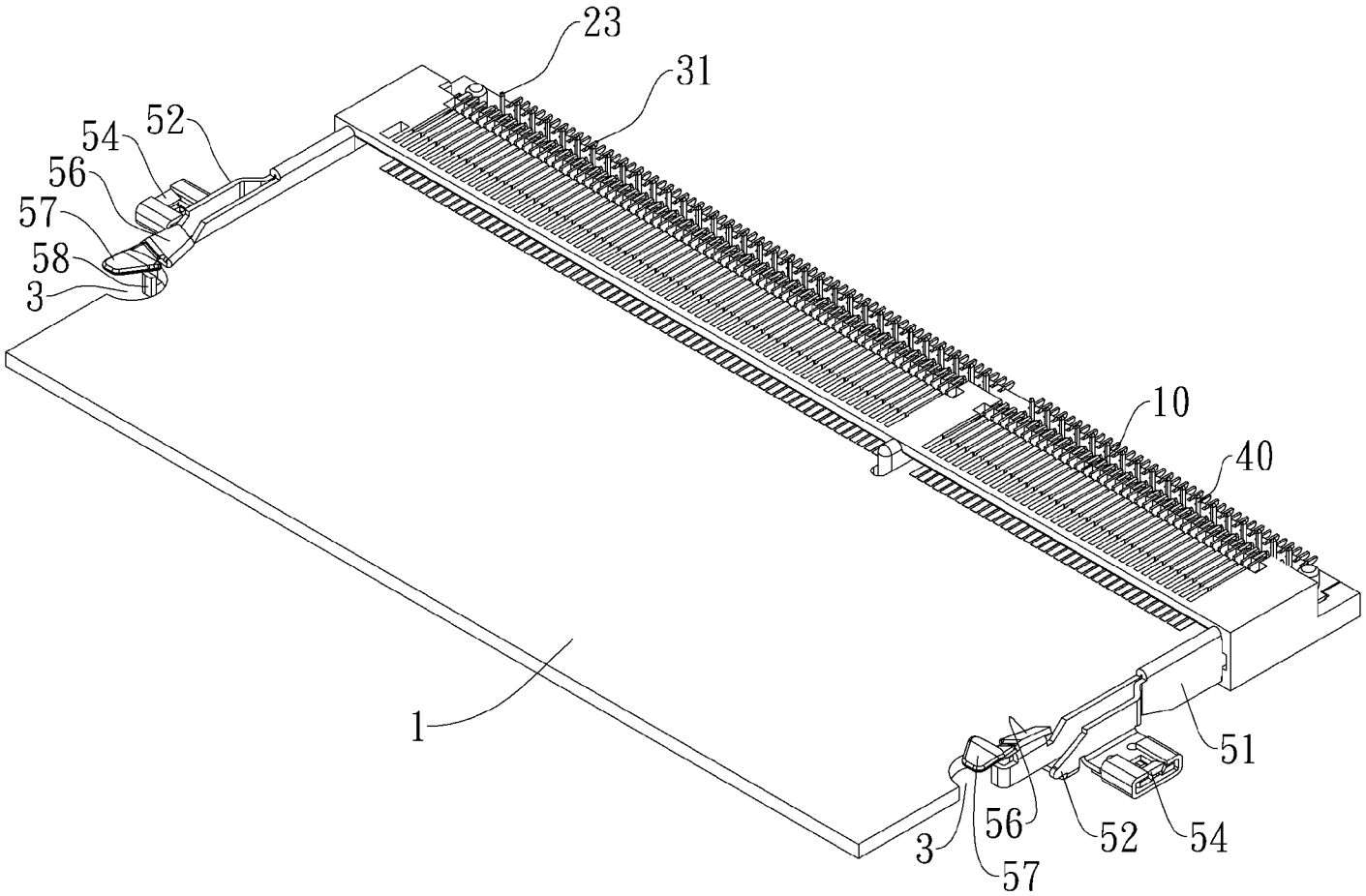
FIG. 8B is a perspective view of the card-edge connector with the electronic card inserted therein.
Figure 8C:
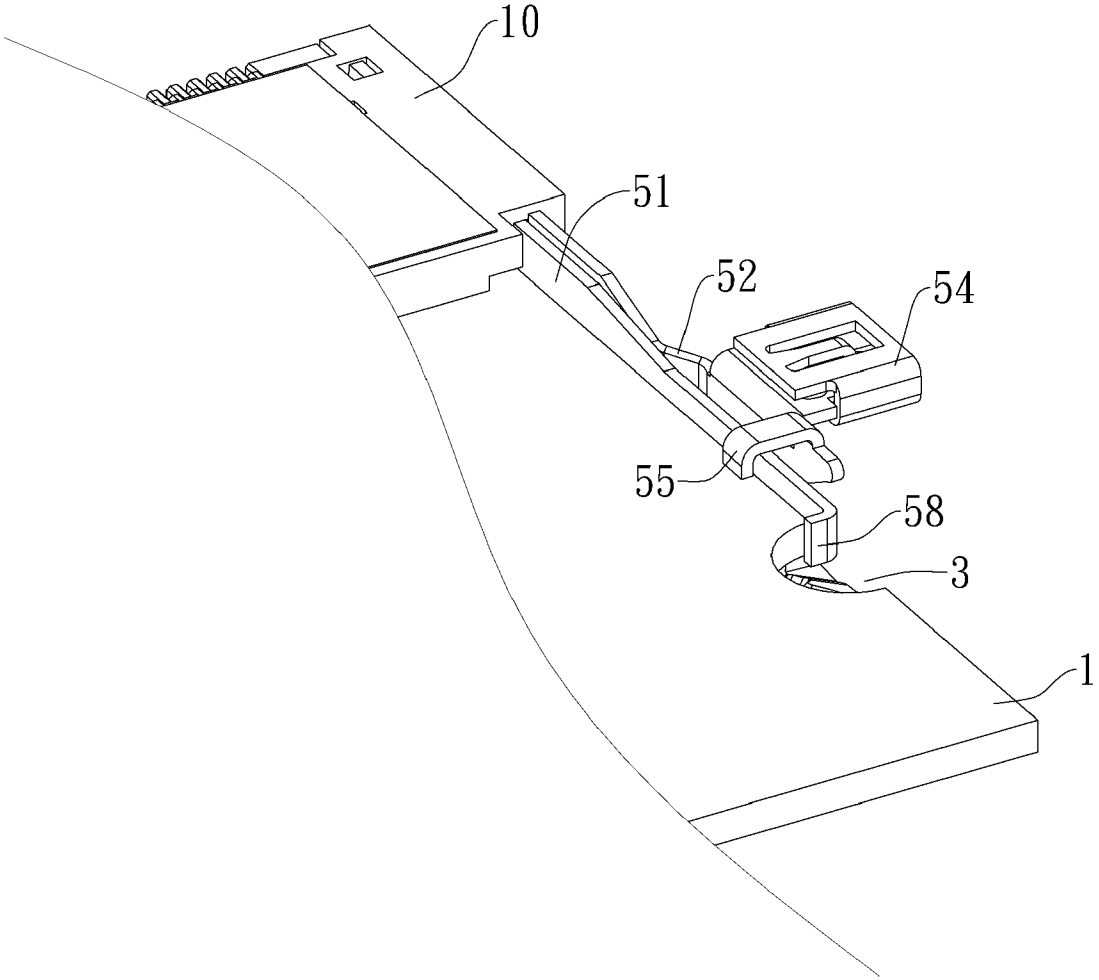
FIG. 8C is a partial enlarged perspective view of the card-edge connector and electronic card inserted therein shown from a different angle.

With reference to FIGS. 8A and 8C, each of the two sides of the electronic card 1 includes a recess 3. To insert the electronic card 1 into the card-edge connector 100 according to the invention, the electronic card 1 is firstly positioned at the front end of the insulative housing 10 and positioned between the set of first conductive terminals 20 and the set of second conductive terminals 30. Then, the electronic card 1 is obliquely inserted and pushed downwardly into the proper position. Next, the clutch portion 56 grasps the electronic card 1, the resting portion 55 supports the electronic card 1 (see FIG. 8C), and the clasp portion 58 positioned at the rear end of the main body 51 of the card latching member 50 engages the recess 3. As a result, the electronic card 1 is secured to the insulative housing 10 according to the invention. In order to eject the electronic card 1 from the card-edge connector 100, the pressing portion 57 of each of the pair of card latching members 50 is pressed to cause an upward tilt of the clutch portion 56, thereby the electronic card 1 free from the clutch portion 56 recoils upwardly and rests obliquely at the front end of the insulative housing 10 for withdrawal.

Figure 9:
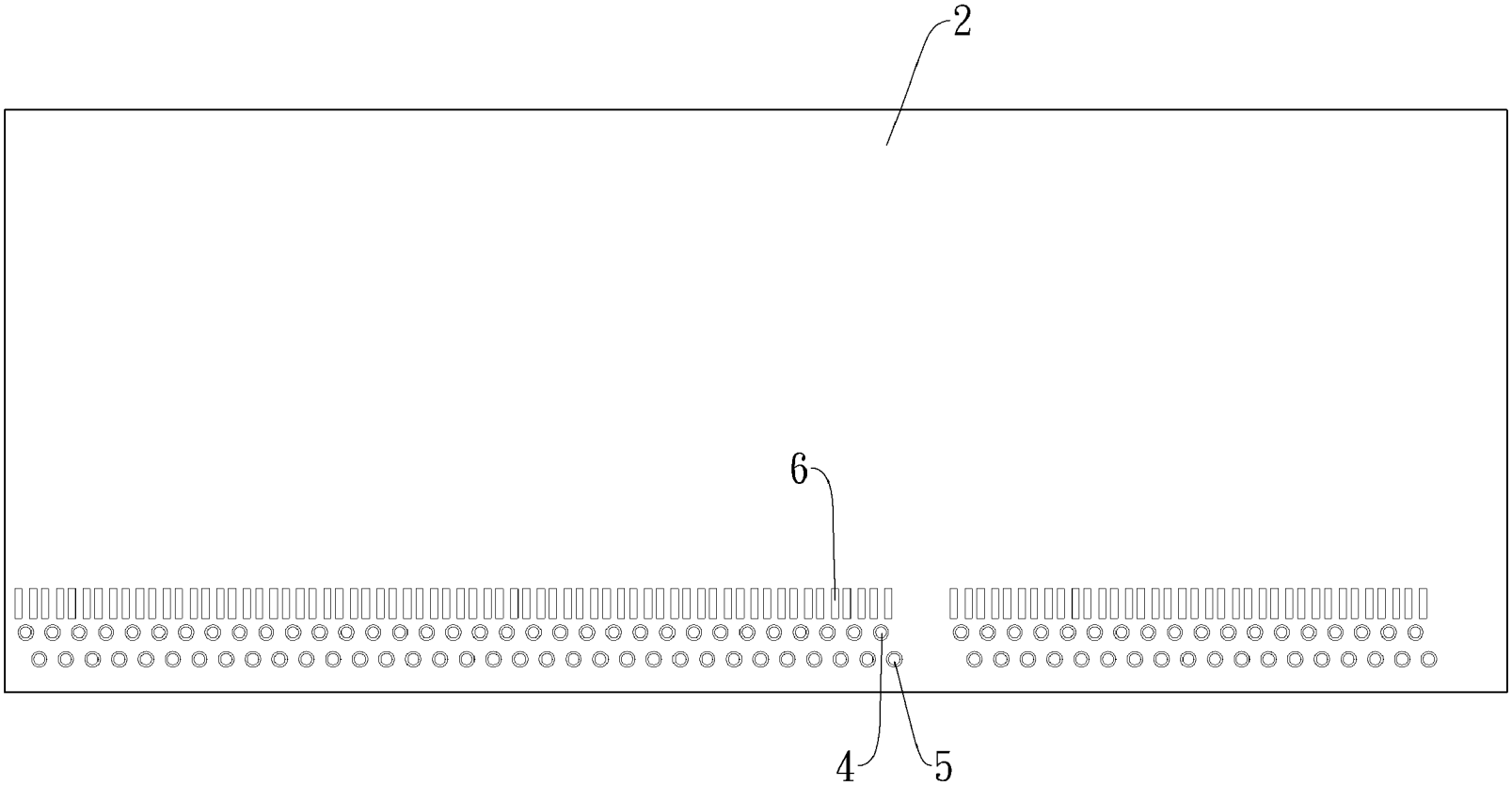
FIG. 9 is a schematic view showing a circuit board configured to connect with a set of first conductive terminals and a set of second conductive terminals of a card-edge connector according to the invention.

FIG. 9 shows a circuit board 2 capable of connecting with the set of first conductive terminals 20 and the set of second conductive terminals 30 of the card-edge connector 100 according to the invention. The circuit board 2 has a plurality of first connection receiving passageways 4 and a plurality of second connection receiving passageways 5 corresponding to the ends of the set of first conductive terminals 20. The plurality of first connection receiving passageways 4 and the plurality of second connection receiving passageways 5 are positioned alternately in a top-down sequence, and the row of the plurality of first connection receiving passageways 4 and the row of the plurality of second connection receiving passageways 5 are parallel with respect to each other, so that the first terminal 21 and the second terminal 22 of the set of first conductive terminals 20 can be favorably soldered to the circuit board 2. Additionally, the circuit board 2 is provided with a plurality of SMT (Surface Mount Technology) contacts 6 corresponding to the ends of the set of second conductive terminals 30. Similarly, the plurality of SMT contacts 6 and the plurality of first connection receiving passageways 4 are also arranged alternately in a top-down sequence, and the row of the plurality of SMT contacts 6 and the row of the plurality of first connection receiving passageways 4 are parallel with respect to each other, so that the set of second conductive terminals 30 can electrically connect with the plurality of SMT contacts 6 when the circuit board 2 is connected with the card-edge connector 100 of the present invention.

The card-edge connector 100 according to the invention is connected with the upper and lower surfaces of the insulative housing 10 thereof through conductive terminals of various sizes. Moreover, the card-edge connector 100 is provided with a set of conductive terminals electrically connected with the plurality of smt contacts 6 to effectively reduce the number of conductive terminals, thereby further reducing the costs.

Although several embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A card-edge connector connecting an electronic card to a circuit board, comprising:

an insulative housing having a plurality of first terminal receiving passageways positioned on an upper surface thereof and open to the upper outer surface and a plurality of second terminal receiving passageways positioned on a lower surface thereof;

a set of first conductive terminals positioned alternately in the plurality of first terminal receiving passageways and having a plurality of exposed end portions;

a set of second conductive terminals positioned in the plurality of second terminal receiving passageways and having a plurality of exposed end portions;

a spacer having a plurality of receiving passageways securing the plurality of exposed end portions of the set of first conductive terminals and a plurality of third terminal receiving passageways positioned at a rear edge securing the plurality of exposed end portions of the set of second conductive terminals; and a pair of card latching members inserted into two catches respectfully positioned at two ends of a front side of the insulative housing.

2. The card-edge connector according to claim 1, wherein one end of each of the plurality of first terminal receiving passageways ends at a rear edge of the upper surface.

3. The card-edge connector according to claim 1, wherein the insulative housing further includes a base extending rearward from a rear edge of the lower surface of the insulative housing.

4. The card-edge connector according to claim 3, wherein the plurality of exposed end portions of the set of first conductive terminals are positioned on the base.

5. The card-edge connector according to claim 4, wherein the plurality of exposed end portions of the set of second conductive terminals are positioned along the base.

6. The card-edge connector according to claim 3, the base includes a horizontal section and two vertical sections extending respectively from two ends of the horizontal section.

7. The card-edge connector according to claim 6, further comprising a receiving passageway positioned in a region where the horizontal section and the vertical section join and a wall of the receiving passageway includes a clasp portion.

8. The card-edge connector according to claim 7, wherein two ends of the spacer include a hook portion corresponding to the clasp portion.

9. The card-edge connector according to claim 1, wherein each of the pair of card latching members includes a main body and an extension extending from one side thereof.

10. The card-edge connector according to claim 9, wherein a front end of the main body includes a pair of insertion sections corresponding to the two catches.

11. The card-edge connector according to claim 1, further comprising an upper cover covering the set of first conductive terminals and a lower cover covering the set of second conductive terminals.

12. The card-edge connector according to claim 1, wherein the circuit board includes a plurality of first connection receiving passageways and a plurality of second connection receiving passageways corresponding to the set of first conductive terminals.

13. The card-edge connector according to claim 12, wherein the plurality of first connection receiving passageways and the plurality of second connection receiving passageways are alternately positioned in a top-down sequence.

14. The card-edge connector according to claim 13, wherein the row of the plurality of first connection receiving passageways and the row of the plurality of second connection receiving passageways are parallel with respect to each other.

15. The card-edge connector according to claim 13, wherein the circuit board includes a plurality of Surface Mount Technology (SMT) contacts corresponding to the set of second conductive terminals.

16. The card-edge connector according to claim 15, wherein the plurality of SMT contacts and the plurality of first connection receiving passageways are alternately positioned in a top-down sequence and the row of the plurality of SMT contacts and the row of the plurality of first connection receiving passageways are parallel with respect to each other.

17. A card-edge connector connecting an electronic card to a circuit board, comprising:

an insulative housing having a plurality of first terminal receiving passageways positioned on an upper surface thereof and a plurality of second terminal receiving passageways positioned on a lower surface thereof;

a set of first conductive terminals positioned alternately in the plurality of first terminal receiving passageways and having a plurality of exposed end portions;

a set of second conductive terminals positioned in the plurality of second terminal receiving passageways and having a plurality of exposed end portions;

a spacer having a plurality of receiving passageways securing the plurality of exposed end portions of the set of first conductive terminals and a plurality of third terminal receiving passageways positioned at a rear edge securing the plurality of exposed end portions of the set of second conductive terminals; and a pair of card latching members inserted into two catches respectfully positioned at two ends of a front side of the insulative housing; and a base extending rearward from a rear edge of the lower surface of the insulative housing.

18. The card-edge connector according to claim 17, wherein one end of each of the plurality of first terminal receiving passageways ends at a rear edge of the upper surface.

19. The card-edge connector according to claim 17, wherein the plurality of exposed end portions of the set of first conductive terminals are positioned on the base.

20. The card-edge connector according to claim 19, wherein the plurality of exposed end portions of the set of second conductive terminals are positioned along the base.

21. The card-edge connector according to claim 17, the base includes a horizontal section and two vertical sections extending respectively from two ends of the horizontal section.

22. The card-edge connector according to claim 21, further comprising a receiving passageway positioned in a region where the horizontal section and the vertical section join and a wall of the receiving passageway includes a clasp portion.

23. The card-edge connector according to claim 22, wherein two ends of the spacer include a hook portion corresponding to the clasp portion.

24. The card-edge connector according to claim 17, wherein each of the pair of card latching members includes a main body and an extension extending from one side thereof.

25. The card-edge connector according to claim 24, wherein a front end of the main body includes a pair of insertion sections corresponding to the two catches.

26. The card-edge connector according to claim 17, further comprising an upper cover covering the set of first conductive terminals and a lower cover covering the set of second conductive terminals.

27. The card-edge connector according to claim 17, wherein the circuit board includes a plurality of first connection receiving passageways and a plurality of second connection receiving passageways corresponding to the set of first conductive terminals.

28. The card-edge connector according to claim 27, wherein the plurality of first connection receiving passageways and the plurality of second connection receiving passageways are alternately positioned in a top-down sequence.

29. The card-edge connector according to claim 28, wherein the row of the plurality of first connection receiving passageways and the row of the plurality of second connection receiving passageways are parallel with respect to each other.

30. The card-edge connector according to claim 28, wherein the circuit board includes a plurality of Surface Mount Technology (SMT) contacts corresponding to the set of second conductive terminals.

31. The card-edge connector according to claim 30, wherein the plurality of SMT contacts and the plurality of first connection receiving passageways are alternately positioned in a top-down sequence and the row of the plurality of SMT contacts and the row of the plurality of first connection receiving passageways are parallel with respect to each other.

32. A card-edge connector connecting an electronic card to a circuit board, comprising:

an insulative housing having a plurality of first terminal receiving passageways positioned on an upper surface thereof and open to the upper outer surface and a plurality of second terminal receiving passageways positioned on a lower surface thereof;

a set of first conductive terminals positioned alternately in the plurality of first terminal receiving passageways and having a plurality of exposed end portions;

a set of second conductive terminals positioned in the plurality of second terminal receiving passageways and having a plurality of exposed end portions;

a spacer having a plurality of receiving passageways and a plurality of third terminal receiving passageways positioned at a rear edge securing the plurality of exposed end portions of the set of first conductive terminals and the plurality of exposed end portions of the set of second conductive terminals; and a pair of card latching members inserted into two catches respectfully positioned at two ends of a front side of the insulative housing;

wherein the circuit board includes a plurality of first connection receiving passageways, a plurality of second connection receiving passageways corresponding to the set of first conductive terminals, and a plurality of Surface Mount Technology (SMT) contacts corresponding to the set of second conductive terminals;

wherein the plurality of first connection receiving passageways and the plurality of second connection receiving passageways are alternately positioned in a top-down sequence, the plurality of SMT contacts and the plurality of first connection receiving passageways are alternately positioned in a top-down sequence, and the row of the plurality of SMT contacts and the row of the plurality of first connection receiving passageways are parallel with respect to each other.

33. A card-edge connector connecting an electronic card to a circuit board, comprising:

an insulative housing having a plurality of first terminal receiving passageways positioned on an upper surface thereof and a plurality of second terminal receiving passageways positioned on a lower surface thereof;

a set of first conductive terminals positioned alternately in the plurality of first terminal receiving passageways and having a plurality of exposed end portions;

a set of second conductive terminals positioned in the plurality of second terminal receiving passageways and having a plurality of exposed end portions;

a spacer having a plurality of receiving passageways and a plurality of third terminal receiving passageways positioned at a rear edge securing the plurality of exposed end portions of the set of second conductive terminals; and a pair of card latching members inserted into two catches respectfully positioned at two ends of a front side of the insulative housing; and a base extending rearward from a rear edge of the lower surface of the insulative housing;

wherein the circuit board includes a plurality of first connection receiving passageways, a plurality of second connection receiving passageways corresponding to the set of first conductive terminals, and a plurality of Surface Mount Technology (SMT) contacts corresponding to the set of second conductive terminals;

wherein the plurality of first connection receiving passageways and the plurality of second connection receiving passageways are alternately positioned in a top-down sequence, the plurality of SMT contacts and the plurality of first connection receiving passageways are alternately positioned in a top-down sequence, and the row of the plurality of SMT contacts and the row of the plurality of first connection receiving passageways are parallel with respect to each other.

* * * * *